US007997195B2

(12) United States Patent
Seo et al.

(10) Patent No.: US 7,997,195 B2
(45) Date of Patent: Aug. 16, 2011

(54) SPACER PRINTING APPARATUS AND METHOD OF PRINTING A SPACER

(75) Inventors: Bong-Sung Seo, Yongin-si (KR); Baek-Kyun Jeon, Yongin-si (KR); Byoung-Hun Sung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 962 days.

(21) Appl. No.: 11/770,031

(22) Filed: Jun. 28, 2007

(65) Prior Publication Data

US 2008/0041253 A1 Feb. 21, 2008

(30) Foreign Application Priority Data

Aug. 16, 2006 (KR) ..... 10-2006-0077294

(51) Int. Cl.
*B41F 17/00* (2006.01)

(52) U.S. Cl. ..... 101/212; 101/41; 101/215; 101/282; 101/372

(58) Field of Classification Search ..... 101/212
See application file for complete search history.

(56) References Cited

U.S. PATENT DOCUMENTS 330,243 A * 11/1885 Lamb ..... 101/212
583,954 A * 6/1897 Thayer ..... 101/212
1,051,213 A * 1/1913 Lyon ..... 101/212
1,204,578 A * 11/1916 Gammeter ..... 101/377
1,655,792 A * 1/1928 Krell ..... 101/65
1,798,655 A * 3/1931 Brugiere ..... 101/5
4,006,684 A * 2/1977 Melzer ..... 101/212
4,010,681 A * 3/1977 Hamberger et al. ..... 101/38.1
4,924,243 A * 5/1990 Sato et al. ..... 349/187
5,343,803 A * 9/1994 Duchek et al. ..... 101/35
5,775,216 A * 7/1998 Rouleau ..... 101/27
2007/0022887 A1 * 2/2007 Seo et al. ..... 101/337

FOREIGN PATENT DOCUMENTS

CN 179409 6/2006

* cited by examiner

*Primary Examiner* — Jill E Culler
(74) *Attorney, Agent, or Firm* — F. Chau & Associates, LLC

(57) ABSTRACT

A spacer-printing apparatus includes a printing roller and a moving part. The printing roller has opposite edges connected by a curved surface and spacers are attached to the curved surface. The moving part is connected with the printing roller and respectively and alternately moves opposite edges up and down. The printing roller has a shape of a portion of cylinder, so that a radius is increased without the increase in volume and weight thereof.

23 Claims, 10 Drawing Sheets

SPACER PRINTING APPARATUS AND METHOD OF PRINTING A SPACER

CROSS-REFERENCE TO RELATED APPLICATION

This application relies for priority upon Korean Patent Application No, 2006-77294 filed on Aug. 16, 2006, the contents of which are herein incorporated by reference in their entirety.

BACKGROUND OF THE INVENTION

1. Technical Field

The present invention relates to a spacer-printing apparatus and a method of printing a spacer, and more particularly, to a spacer-printing apparatus and a method of printing a spacer, which are capable of reducing the cost of manufacturing a display panel.

2. Discussion of the Related Art

A liquid crystal display (LCD) apparatus includes an LCD panel showing images by using light transmissivity of liquid crystal and may include a backlight assembly disposed under the LCD panel and applying light to the LCD panel.

The LCD panel may include a first substrate, a second substrate, a liquid crystal layer, a seal line and a spacer. Thin film transistors are disposed on the first substrate. The second substrate includes a color fitter and faces the first substrate. The liquid crystal layer is disposed between the first and second substrates. The seat line disposed between the first and second substrates seals the liquid crystal layer. The spacer between the first and second substrates maintains a cell gap between the first and second substrates.

Methods of forming a liquid crystal layer may include an injection method and a dropping method.

According to the dropping method, the seal line and the spacers are disposed, for example, on the second substrate. The liquid crystal is dropped, for example, on the first substrate. Then, the first and second substrates are assembled in a vacuum.

The spacers may be printed, for example, on the second substrate by a printing roller having a cylindrical shape. However, when the LCD panel becomes larger in size, the second substrate also becomes larger in size. As a result, a radius of the printing roller becomes larger.

When a radius of the printing roller becomes larger, volume and weight of the printing roller is increased. The increase of equipment size increases manufacturing cost. In addition, due to the large size of the printing roller, when spacers on the printing roller are transcribed onto the second substrate, the spacers are not stably transcribed onto the second substrate, and remain on a printing board.

SUMMARY OF THE INVENTION

Embodiments of the present invention provide a spacer-printing apparatus capable of reducing a cost of manufacturing a display panel, and a method of printing a spacer.

The spacer-printing apparatus, according to an embodiment of the present invention, includes a printing roller and a moving part.

Opposite edges of the printing roller are connected with a curved surface. Spacers are attached to the curved surface. The moving part is connected with the printing roller and respectively and alternately moves opposite edges up and down. For example, a cross-section of the curved surface is substantially symmetric with respect to a centerline of the cross-section. For example, a cross section of a curved surface is a substantially circular arc/a portion of a circumference. A portion of the moving part is connected to the printing roller and the moving part may include a plurality of pistons respectively and alternately moving opposite edges of the printing roller up and down.

A spacer-printing apparatus, according to an embodiment of the present invention, includes a hollow cylindrical shape and a printing roller. A all spacer is attached to the outside of the printing roller.

A method of printing a spacer, in accordance with an embodiment of the present invention, includes attaching a spacer to a printing roller, opposite edges of the printing roller being connected with a curved surface, and attaching the spacer to a display board by respectively and alternately moving opposite edges of the printing roller up and down for the curved surface to make contact with a display board by using a moving part connected with the printing roller.

A method of printing a spacer, in accordance with an embodiment of the present invention, includes attaching spacer to a printing roller having a hollow cylindrical shape, and attaching the spacer to a display board by rotating the printing roller on the display board.

By reducing a portion of a printing roller having a cylindrical shape, volume and weight of a printing roller is reduced although a radius of a printing roller increases. As a result manufacturing cost is decreased.

BRIEF DESCRIPTION OF THE DRAWINGS

Exemplary embodiments of the present invention can be understood in more detail from the following descriptions taken in conjunction with the accompanying drawings wherein.

DETAILED DESCRIPTION OF EMBODIMENTS

The invention is described more fully hereinafter with reference to the accompanying drawings, in which embodiments of the invention are shown. This invention may, however, be embodied in many different forms and should air not be construed as limited to the embodiments set forth herein.

It will be understood that when an element or layer is referred to as being "on", "connected to" or "coupled to" another element or layer, it can be directly on, connected or coupled to the other element or layer or intervening elements or layers may be present.

Figure 1:
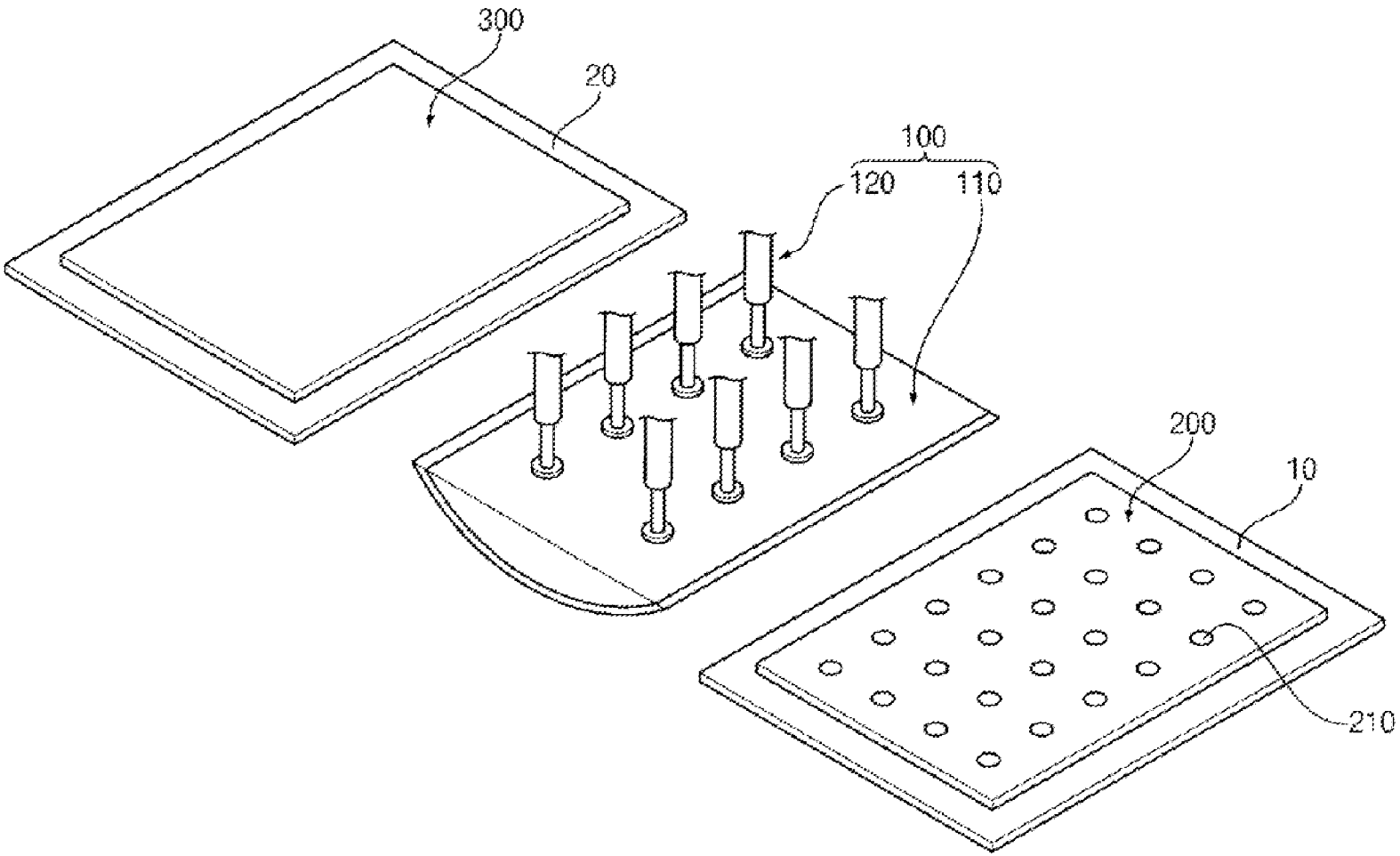
FIG. 1 is a perspective view illustrating a spacer-printing apparatus in accordance with an exemplary embodiment of the present invention.

FIG. 1 is a perspective view illustrating a spacer-printing apparatus in accordance with an embodiment of the present invention.

Referring to FIG. 1, a spacer-printing apparatus 100 includes a printing roller 110 and a moving part 120. The spacer-printing apparatus prints an ink spacer (not shown) disposed at a printing board 200 onto a display board 300.

Specifically, the spacer-printing apparatus 100 makes contact with a surface of printing board 200 disposed on a first stage 10. As a result of the contact with the printing board 200, an ink spacer is attached onto an external surface of printing roller 110. Then, the external surface of printing roller 110 having an ink spacer contacts a surface of a display board 300 disposed on a second stage 20. An ink spacer from the external surface of a printing roller 110 is then attached onto a display board 300.

A printing board 200 includes a plurality of receiving grooves 210. The receiving grooves 210 have a predetermined depth. An ink spacer fills each receiving groove 210. An ink spacer includes a plurality of spacers and sticking ink covering the spacers.

Figure 2:
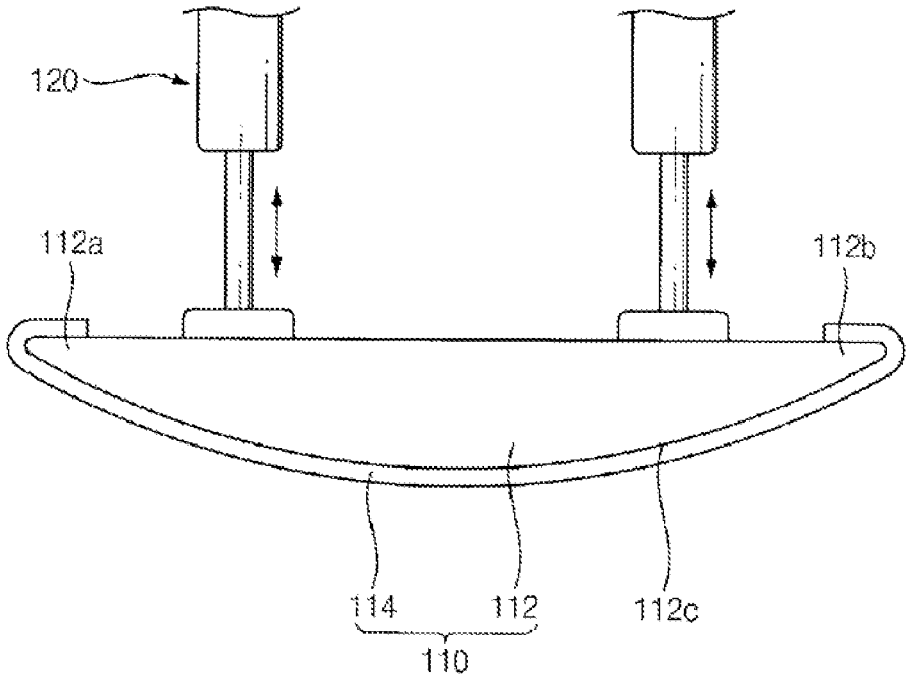
FIG. 2 is a cross sectional view of the spacer-printing apparatus in FIG. 1.

FIG. 2 is a cross sectional view of the spacer-printing apparatus in FIG. 1.

Referring to FIGS. 1 and 2, a spacer-printing apparatus 100 includes a printing roller 110 and moving part 120. An ink spacer is attached onto the printing roller 110. The moving part 120 moves the printing roller 110.

Opposite edges of the printing roller 110 are connected with a curved surface. An ink spacer is attached onto the curved surface. The printing roller 110 includes a main body part 112 and an external surface part 114.

Opposite edges 112*a* and 112*b* of a main body part 112 are connected with a curved surface 112*c*. For example, a cross-section of a curved surface 112*c* of a main body part 112 has a substantially symmetric shape. For example, a cross section of a curved surface 112*c* is a substantially circular arc or a portion of a substantially circular circumference. A length of the circular arc may range from about 1/18 to about ½ of the total length of the circular circumference. The length of the circular arc may range from about ⅙ to about ⅓ of the total length of the circular circumference.

When a main body part 112 is a portion of a cylinder, a radius can be increased without increasing volume and weight.

An external surface part 114 is disposed on a curved surface 112*c* of a main body part 112. An ink spacer is attached onto the external surface part 114. Optionally, an external surface part 114 extends to an upper surface of a main body part 112 to cover opposite edges 112*a* and 112*b*.

An external surface part 114 may include, for example, synthetic resins capable of holding an ink spacer. An external surface part 114 includes for example, an elastic material to prevent breakage of an ink spacer, when the ink spacer is attached thereon.

Moving part 120, comprising, for example, a plurality of pistons, is connected to a printing roller 110. The moving part 120 respectively and alternately moves opposite edges 112*a* and 112*b* of a printing roller 110 up and down. When one edge 112*a* goes up, the other edge 112*b* goes down, and vice versa.

For example, moving part 120 includes a plurality of pistons moving opposite edges 112*a* and 112*b* of a printing roller 110. For example, a plurality of pistons are disposed on an upper surface of a printing roller 110 in two lines and are connected to a printing roller 110.

When the external surface part 114 disposed on the curved surface 112*c* of a main body part 112 makes contact with the printing plate 200, and moving parts 120 move opposite sides 112*a* and 112*b* of a printing roller 110, an ink spacer of a printing board 200 is transferred to an external surface part 114.

Then, when the external surface pan 114 having the ink spacer attached thereon makes contact with a display board 300, and moving part 120 moves opposite sides 112*a* and 112*b* of a printing roller 110, the ink spacer is transferred from the external surface part 114 to the display board 300.

When a radius of the main body part 112 increases, a contact area between the external surface part 114 and the printing board 200 or between the external surface pan 114 and the display board 300 also increases. The external surface part 114 is disposed on a curved surface 112*c* of a main body pan 112. As a result of the increased radius, an ink spacer can be attached onto the external surface part 114 or the display board 300 with higher stability than when the radius is smaller. The main body part 112 has a shape of a portion of a cylinder. As a result, the radius of the main body part 112 can be increased without increase in volume and weight. As a result, an increase of manufacturing cost associated with controlling a larger and heavier main body part can be prevented.

Figure 3:
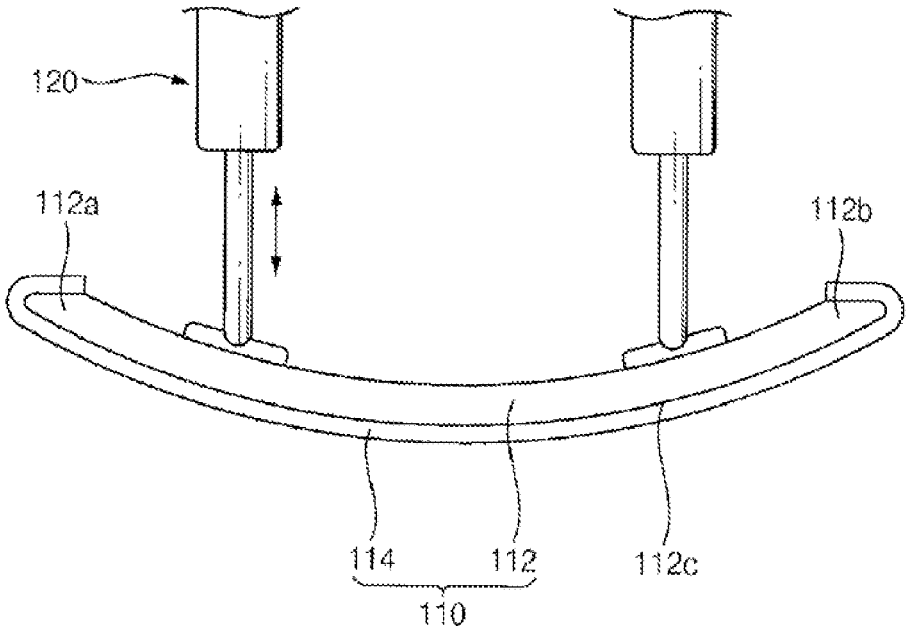
FIG. 3 is a cross sectional view of a spacer-printing apparatus in accordance with an exemplary embodiment of the present invention.

FIG. 3 is a cross sectional view of a spacer-printing apparatus in accordance with an exemplary embodiment of the present invention.

Referring to FIGS. 1 and 3, a spacer-printing apparatus 100 includes a printing roller 110 and a moving part 120. An external surface part 114 and a moving part 120 according to this embodiment are substantially the same as that in FIGS. 1 and 2. Opposite edges 112*a* and 112*b* of a main body part 112 are connected with the curved surface 112*c*. For example, a section of a curved surface 112*c* of a main body part 112 has a substantially symmetric shape. For example, a cross section of a curved surface 112*c* is an arc or a portion of a substantially circular circumference.

Referring to FIG. 3, a section of a main body part 112 has a concave shape. More specifically, an upper surface of a main body part 112 has a concave shape, and a lower surface of a main body part 112 (i.e., curved surface 112*c*) has a convex shape.

Opposite edges 112*a* and 112*b* of a main body part 112 are connected with the curved surface 112*c*, and, relative to FIG. 2, a portion of the main body part 112 is removed to result in a concave shape. As a result, volume and weight of a main body part 112 is further decreased.

Figure 4:
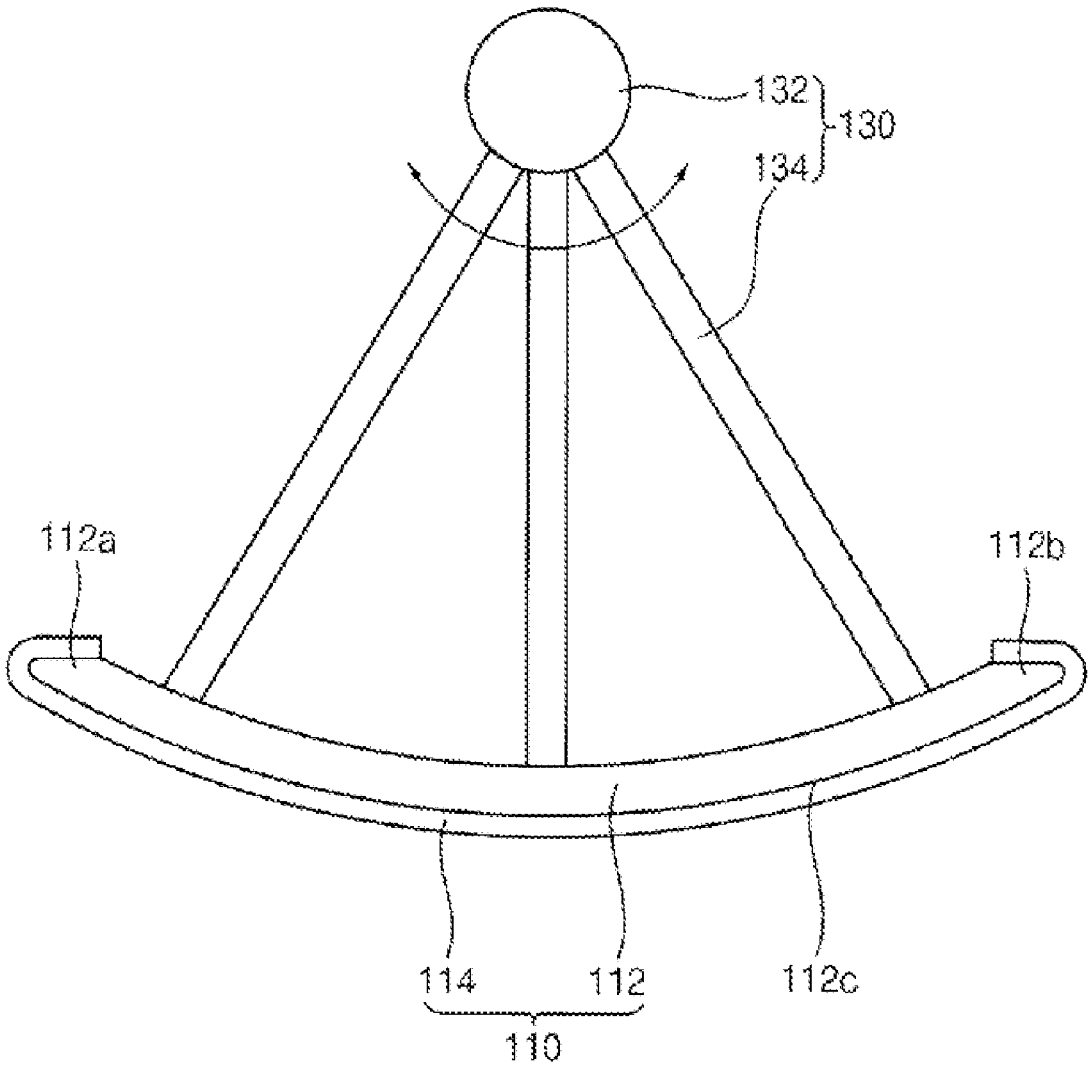
FIG. 4 is a cross sectional view of a spacer-printing apparatus in accordance with an exemplary embodiment of the present invention.

FIG. 4 is a cross sectional view of a spacer-printing apparatus in accordance with an exemplary embodiment of the present invention.

Referring to FIGS. 1 and 4, a spacer-printing apparatus includes a printing roller 110 and a moving part 130. An external surface part 114 and a main body part 112 according to this embodiment are substantially the same as that in FIG. 3. The moving part 130 includes a rotating center axis 132 and a plurality of supporting members 134. The rotating center axis 132 rotates by a predetermined angle. The plurality of supporting members 134 connects the rotating center axis 132 and the printing roller 110.

When a cross section of a curved surface 112*c* is an arc or a portion of a substantially circular circumference, a rotating center axis 132 is disposed at the center of a circle defined by the circular circumference. Supporting members 134 connect the rotating center axis 132 and the printing roller 110. The supporting members 134 respectively and alternately move opposite edges 112*a* and 112*b* up and down by rotation of the rotating center axis 132.

When an external surface part 114 disposed on a curved surface 112*c* of a main body part 112 makes contact with a printing board 200 and a rotating center axis 132 rotates by a predetermined angle, an ink spacer of a printing board 200 is transferred to an external surface part 114.

Then, when the external surface part 114 having the ink spacer attached thereto makes contact with a display board 300 and a rotating center axis 132 rotates by a predetermined angle, the ink spacer is transferred from the external surface part 114 to the display board 300.

Figure 5:
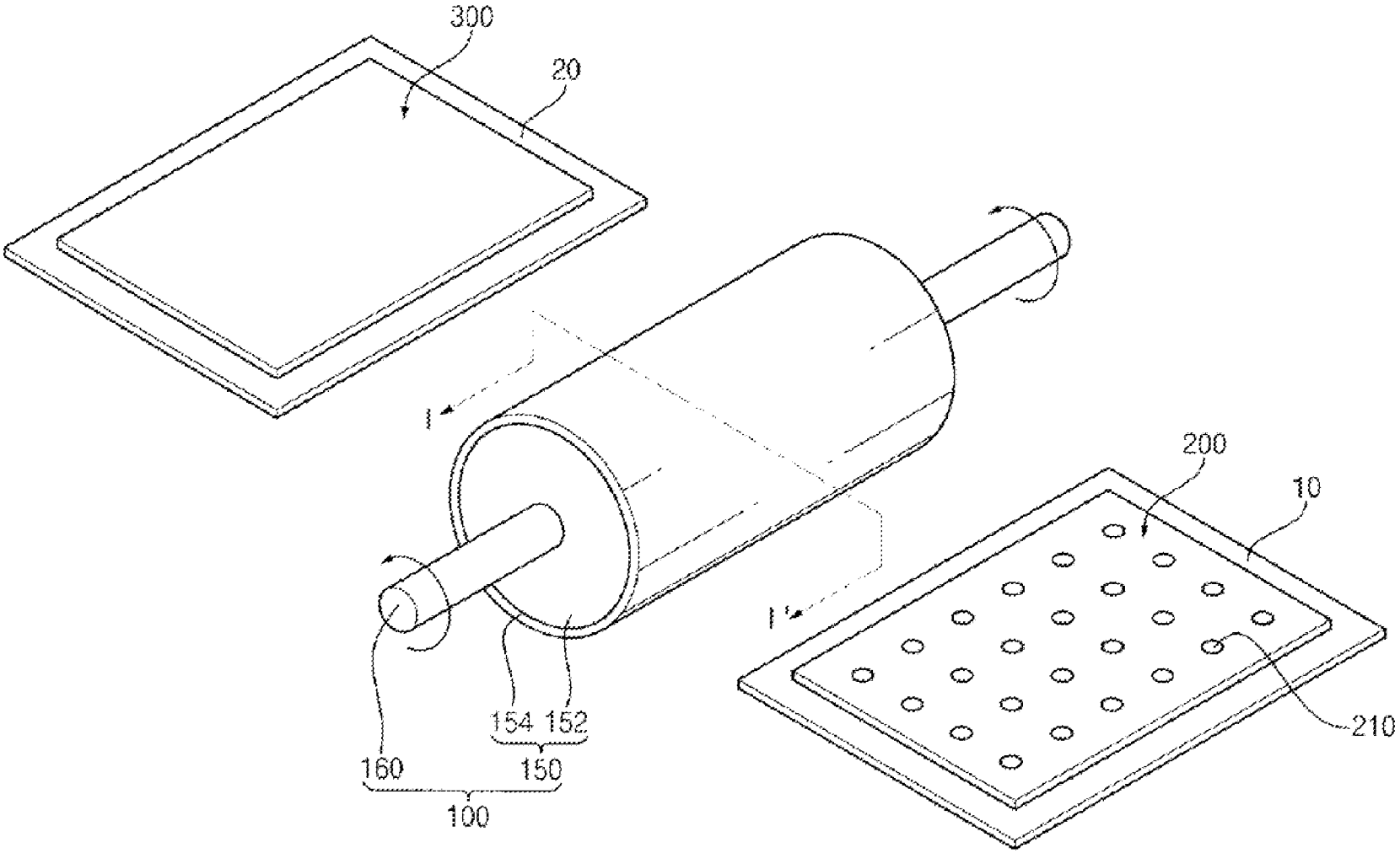
FIG. 5 is a perspective view illustrating a spacer-printing apparatus in accordance with an exemplary embodiment of the present invention.
Figure 6:
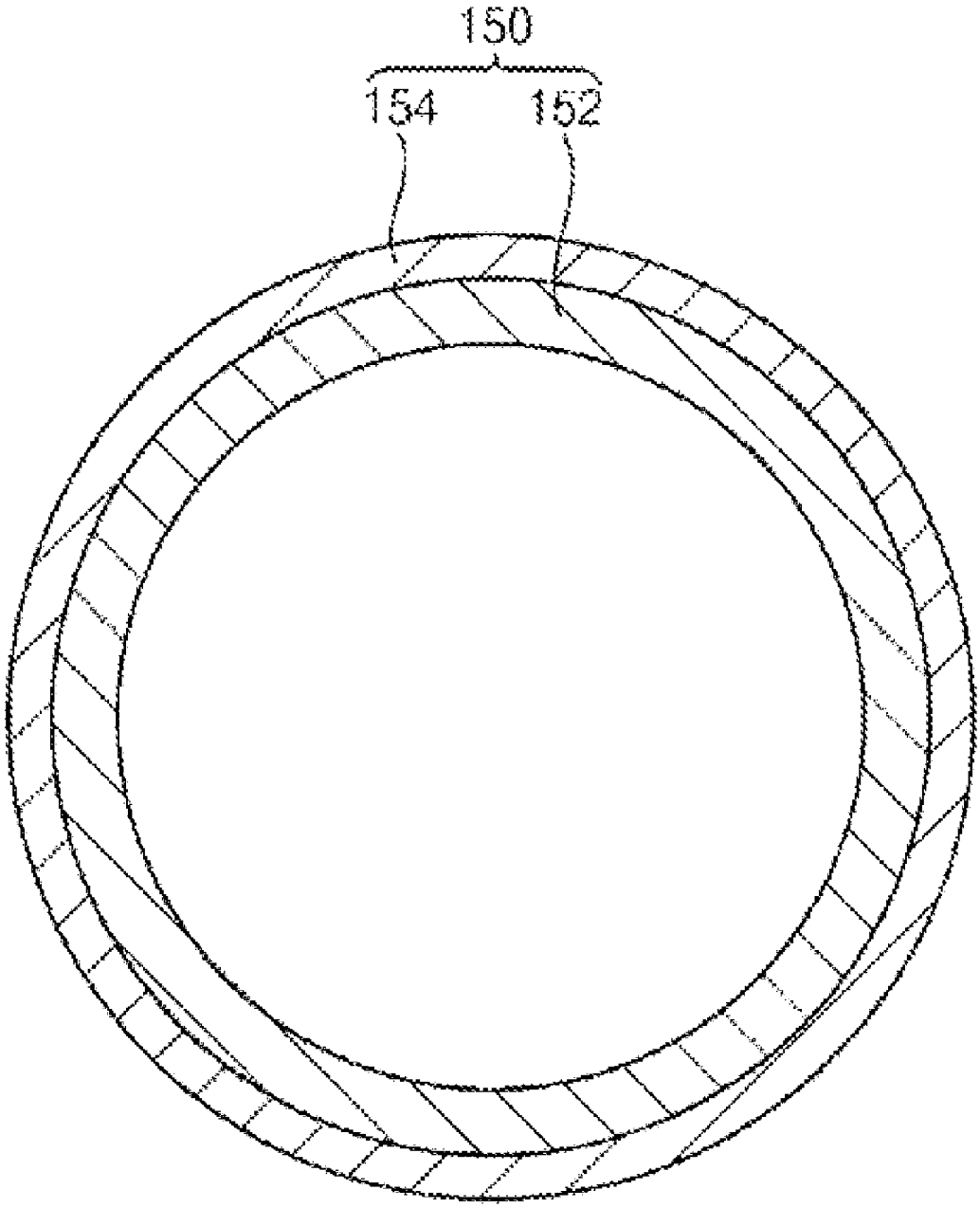
FIG. 6 is a cross sectional view taken along the line I-I' in FIG. 5.

FIG. 5 is a perspective view illustrating a spacer-printing apparatus in accordance with an exemplary embodiment of the present invention, and FIG. 6 is a cross sectional view taken along the line I-I' in FIG. 5.

Referring to FIGS. 5 and 6, a spacer-printing apparatus 100 includes a printing roller 150 and a moving part 160.

For example, a printing roller 150 has a hollow cylindrical shape. An ink spacer is attached onto an external surface of the printing roller 150 by rotating the printing roller 150 to contact a surface of a printing board 200, so that the ink spacer is attached onto the external surface of the printing roller. Then the printing roller 150 rotates to contact a surface of a display board 300, so that the ink spacer of the printing roller 150 is attached onto a surface of a display board 300.

The printing roller 150 includes a main body part 152 and an external surface part 154.

For example, the main body part 152 has a hollow cylindrical shape. Thus, volume and weight of a main body part 152 can be decreased.

The external surface part 154 is disposed onto the main body part 152. An ink spacer is disposed on the external surface part 154. For example, an external surface part 154 includes synthetic resins capable of holding an ink spacer. An external surface part 154 includes, for example, an elastic material to prevent breakage, when an ink spacer attaches to the external surface part.

A moving part 160 is connected to a printing roller 150 and rotates the printing roller 160. For example, the moving part 160 may be disposed at a center axis of the main body part 152 and rotates the main body part 152.

Since a main body part 152 has a shape of a hollow cylinder, a radius of the main body part 152 may be increased without the increase of volume and weight. As a result, cost for manufacturing a display panel may be reduced.

FIGS. 7A, 7B, 7C and 7D are cross-sectional views showing a method of printing a spacer in accordance with an exemplary embodiment of the present invention.

Figure 7A:
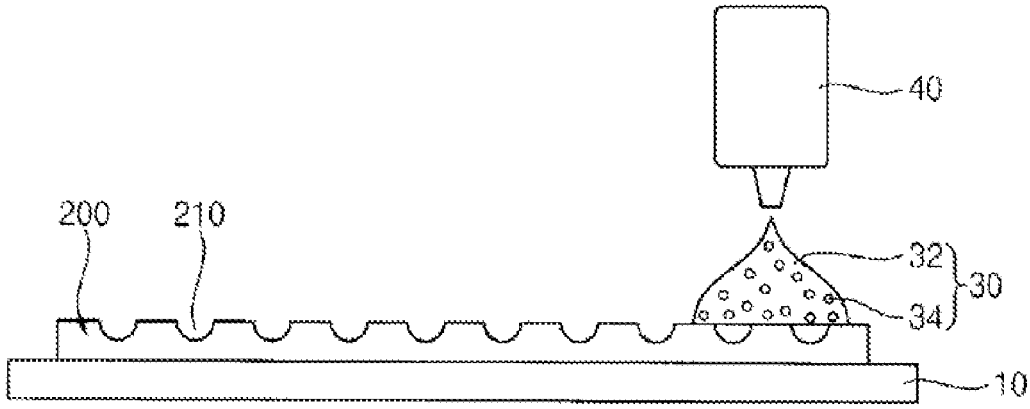
FIGS. 7A, 7B, 7C and 7D are cross-sectional views showing a method of printing a spacer in accordance with an exemplary embodiment of the present invention.
Figure 7B:
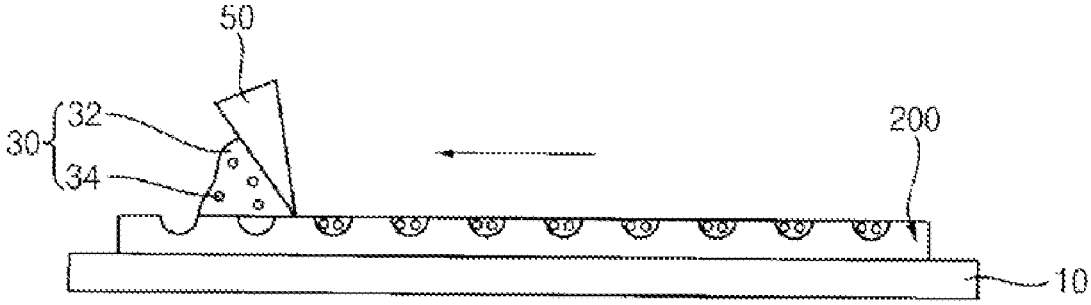
Figure 7C:
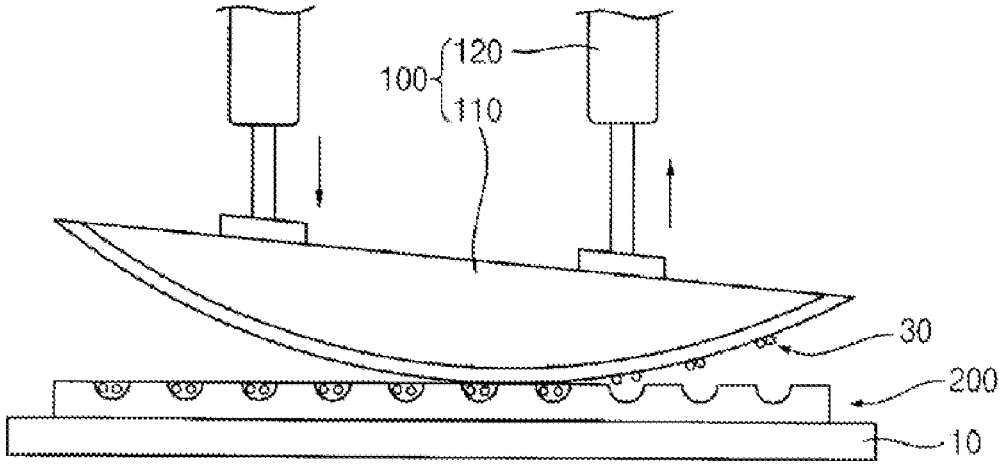
Figure 7D:
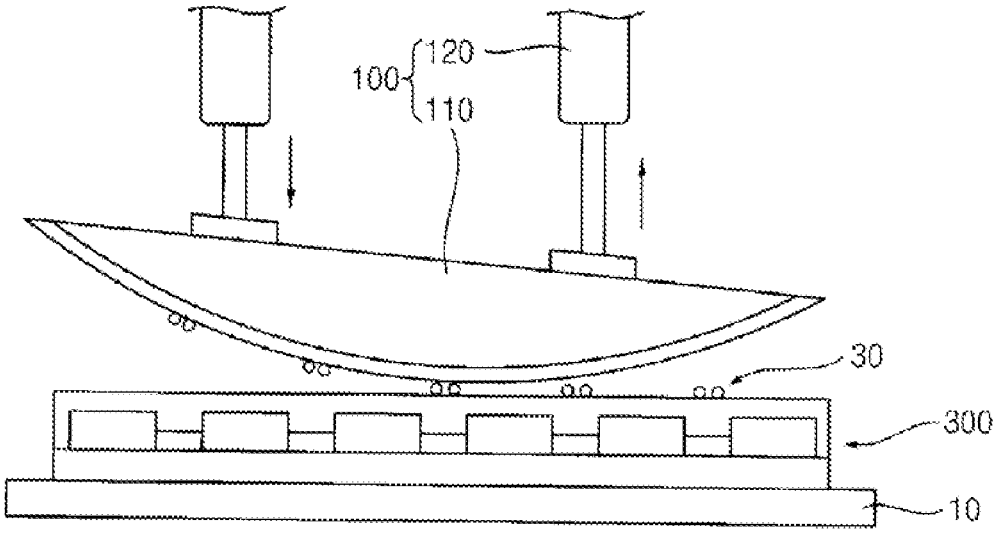

In detail, FIG. 7A is a cross-sectional view showing a step of dropping an ink spacer onto a printing board. FIG. 7B is a cross-sectional view showing a step of filling a receiving groove of the printing board with an ink spacer. FIG. 7C is a cross-sectional view showing a step of attaching an ink spacer onto an external surface of a printing roller. FIG. 7D is a cross-sectional view showing a step of attaching an ink spacer onto a display board.

Referring to FIG. 1 and FIG. 7A, an ink spacer 30 is dropped onto a printing board 200 with an ink spacer dropping machine 40. For example, the ink spacer 30 is dropped onto a portion of a printing board 200.

The ink spacer 30 dropped onto a printing board 200 includes ink 32 having viscosity and a plurality of spacers 34 spread in the ink 32.

The ink 32 has a predetermined viscosity and may be hardened by heat. For example, the ink 32 includes melamine resin or polyester resin.

Spacers 34 are irregularly distributed in the ink 32. For example, a dispersed amount of spacers has a range from about 30 wt % to about 40 wt % in comparison with total weight. For example, each spacer 34 has a sphere shape and a diameter of the sphere has a range from about 3 μm to about 5 μm.

A printing board 200 includes a plurality of receiving grooves 210. Each of the plurality of receiving grooves 210 is separated from each other by a predetermined distance. For example, in a plan view, receiving grooves 210 are disposed in a matrix.

Referring to FIG. 1 and FIG. 7B, ink spacers 30 fill in the receiving grooves 210 of a printing board 200 by moving a blade 50 in a predetermined direction on a printing board 200. For example, five to eight spacers 34 fill in each of the receiving grooves 210.

Referring to FIG. 1 and FIG. 7C, by contacting the curved surface of the printing roller 110 with a printing board 200, and respectively and alternately moving opposite edges of the printing roller 110 up and down using the moving part 120, the ink spacers 30 disposed on the printing board 200 are transferred to the curved surface of the printing roller 110. The ink spacers 30 attached to the curved surface of a printing roller 110 are disposed with a predetermined distance therebetween. As a result, a plurality of spacer-dots is formed.

Since the ink 32 has a predetermined viscosity, the ink spacer 30 may be easily attached to the curved surface of the printing roller 110. For example, the ink 32 is more easily attached to the curved surface of a printing roller 110 than the printing board 200.

Referring to FIG. 1 and FIG. 7D, the printing roller 110 having the ink spacers 30 attached thereto is disposed over the display board 300. Then, the curved surface of the printing roller 110 makes contact with a display board 300 and opposite edges of the printing roller 110 are respectively and alternately moved up and down by using the moving part 120. As a result, the ink spacers 30, or the spacer-dots are transferred to the display board 300.

Since the ink 32 has a predetermined viscosity, the ink spacer 30 is easily attached to the display board 300. For example, the ink 32 is more easily attached to the display board 300 than a printing roller 110.

For example, the display board 300 is a color filter board including a light-blocking layer, color filters and a common electrode. Preferably, ink spacers 30 are attached to positions corresponding to the light-blocking layer.

For example, an area of display board 300 is substantially the same as an area of the printing board 200 and an area of an external surface of a printing roller 110.

Opposite edges of a printing roller are connected with a curved surface. For example, a cross-section of the curved surface of a printing roller 110 has a portion of a substantially circular circumference (or arc) shape. The moving part 120 is connected with the printing roller 110 and respectively and alternately moves opposite edges of the printing roller 110 up and down. For example, a moving part 120 includes a plurality of pistons respectively and alternately moving opposite edges of a printing roller 110 up and down.

Alternatively, a moving part 130 as shown in FIG. 4 includes a rotating center axis 132 and connecting and supporting members 134. The rotating center axis 132 rotates by a predetermined angle. The connecting and supporting members 134 connect the rotation center axis 132 and a printing roller 110 and move a printing roller 100 by rotation of the rotating center axis 132.

In another alternative, the spacer-printing apparatus 100 for the present method can include a hollow cylindrical shape printing roller 150 and a rotating part 160 rotating a printing roller 150 as shown in FIGS. 5 and 6.

Figure 8:
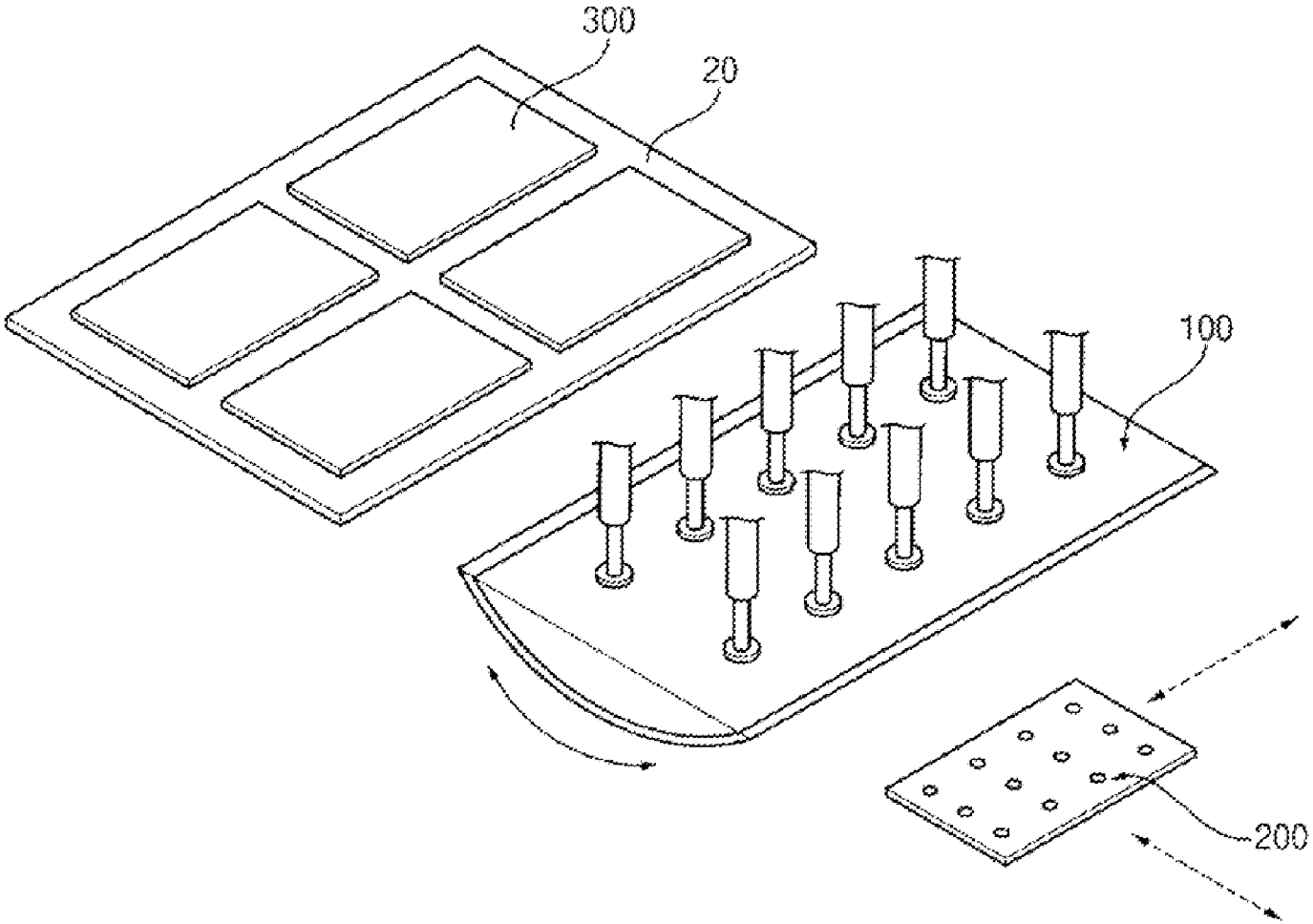
FIG. 8 is a perspective view for explaining a method of printing a spacer in accordance with an exemplary embodiment of the present invention.

FIG. 8 is a perspective view for explaining a method of printing a spacer in accordance with an exemplary embodiment of the present invention.

A method of printing a spacer in accordance with an embodiment will be explained referring to FIGS. 8, 7A, 7B, 7C and 7D. A spacer-printing apparatus 100, a printing board 200 and a plurality of display panels 300 are arranged. For example, a plurality of display boards 300 is arranged on a working stage 20 in a matrix. For example, an area of each display board 300 is substantially the same as an area of a printing board 200.

Then, ink spacers 30 are dropped onto the printing board 200 by using an ink spacer dropping machine 40. The ink spacers 30 fill in receiving grooves 210 of a printing board 200 by using a blade 50.

Then, ink spacers 30 are attached to portions of a curved surface of a printing roller 110 by respectively and alternately moving opposite edges of a printing roller 110 up and down by using a moving part 120. For example, an area of a curved surface of a printing roller 110 may be larger than an area of a printing board 200. For example, if the number of display boards 300 is N, an area of a curved surface of a printing roller 110 is N-times larger than an area of a printing board 200.

The ink spacers 30 fill in receiving grooves of the printing board 200 again. The printing board 200 is moved relative to a printing roller 110. The ink spacers 30 are attached to other portions of a curved surface of a printing roller 110 by the moving part 120. By repeating the above processes, the ink spacers 30 are attached to all or substantially all curved surfaces of a printing roller 110.

Then, the printing roller 110 having ink spacers 30 attached thereto is disposed over the display board 300. The ink spacers 30 are transferred to a plurality of display boards 300 at the same time by a moving part 120.

By a process of moving the printing board 200 relative to a printing roller 110, the ink spacers 30 are attached to all or substantially all portions of the curved surface of the printing board 110, and the ink spacers 30 are attached to a plurality of display boards at the same time. As a result, working efficiency of printing spacers can be enhanced.

Figure 9:
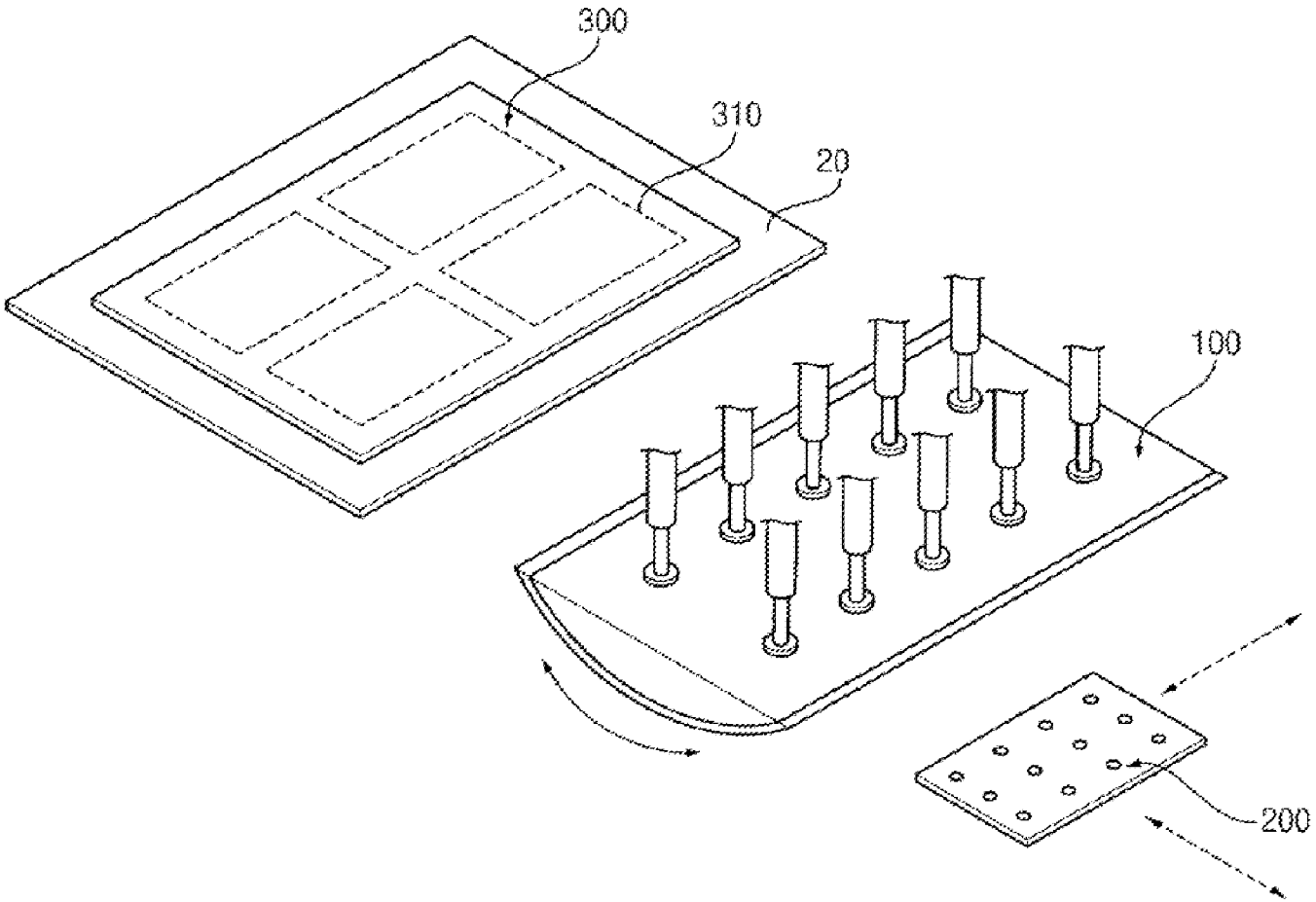
FIG. 9 is a perspective view for explaining a method of printing a spacer in accordance with an exemplary embodiment of the present invention.

FIG. 9 is a perspective view for explaining a method of printing a spacer in accordance with an exemplary embodiment of the present invention.

Referring to FIG. 9, 7A, 7B, 7C and FIG. 7D, a method of printing a spacer will be explained.

One spacer-printing apparatus 100, one printing board 200 and a display board having a plurality of display parts are arranged. The display parts are disposed on the display board 300 in a matrix.

Then, ink spacers 30 are dispersed on a printing board 200 by using the ink spacer dropping machine 40. The ink spacers 30 fill in receiving grooves 210 of the printing board 200 by using a blade 50.

Then, ink spacers 30 are attached to portions of the curved surface of the printing roller 110 by respectively and alternately moving opposite edges of a printing roller 110 up and down by using the moving part 120. For example, an area of the curved surface of a printing roller 110 may be larger than an area of the printing board 200. The area of the curved surface of the printing roller 110 corresponds to the area of display regions. For example, the area of a printing board 200 is substantially the same as the area of each display region 310. The area of the curved surface of the printing roller 110 is larger or substantially the same as a sum of the areas of display regions 310 of the display board 300.

Then, the ink spacers 30 fill in receiving grooves of a printing board 200 and the printing board 200 is moved relative to the printing roller 110. Next, by using the moving part 120 again, the ink spacers 30 are attached to other portions of the curved surface of the printing roller 110. By repeating the above processes, the ink spacers 30 are attached to all or substantially all portions of a curved surface of a printing board 110.

Then, after a printing roller 110 having the ink spacers 30 attached thereto is disposed over the display board 300, the ink spacers 30 are attached onto a plurality of display regions 310 at the same time by using the moving part 120.

Then, each of the display regions 310 is cut out from the display board 300, and a plurality of sub display boards having each respective display region 310 are formed. For example, each of the display regions 310 is cut out by a laser cutting device.

Figure 10:
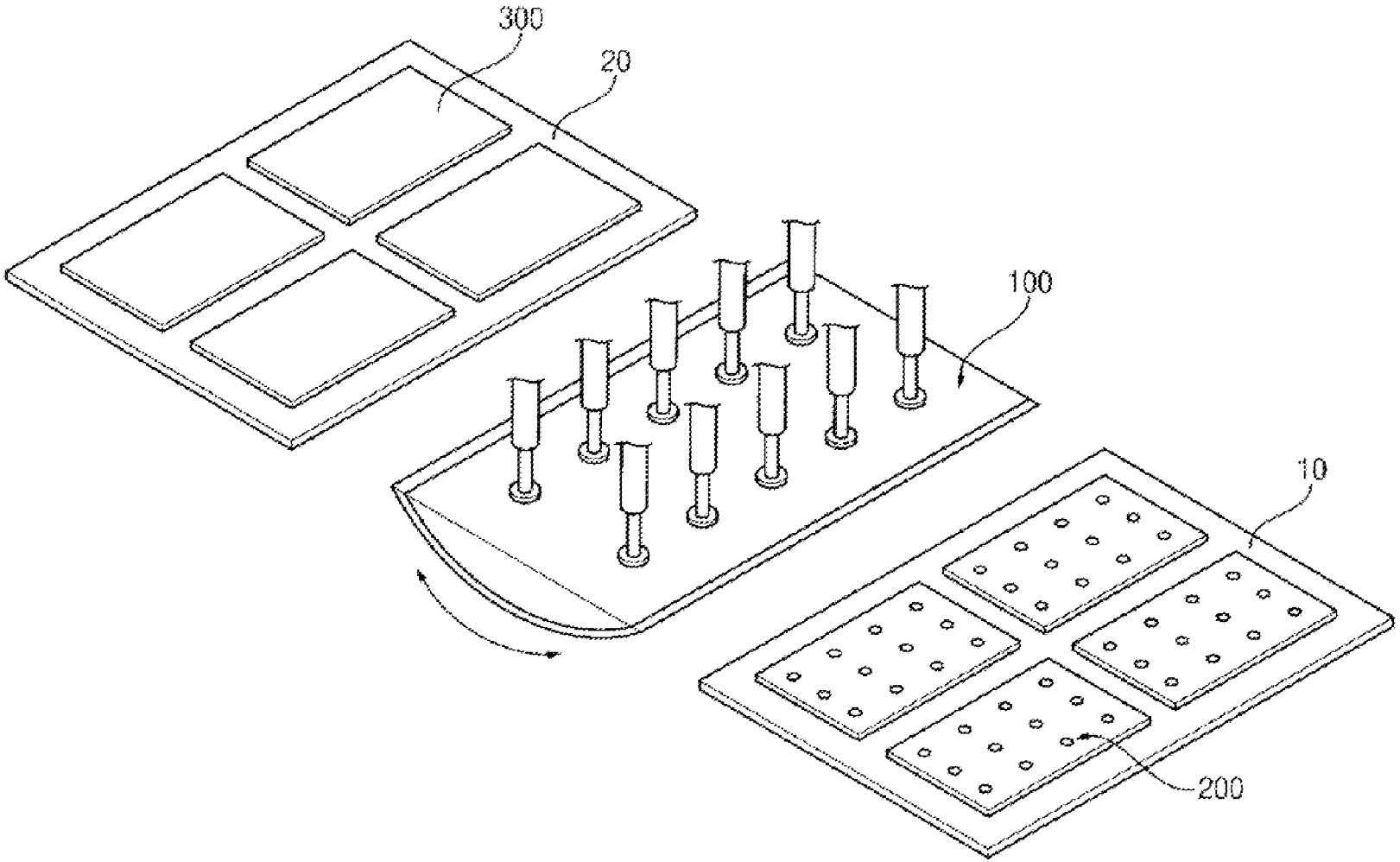
FIG. 10 is a perspective view for explaining a method of printing a spacer in accordance with an exemplary embodiment of the present invention.

FIG. 10 is a perspective view for explaining a method of printing a spacer in accordance with an exemplary embodiment of the present invention.

Referring to FIGS. 10, 7A, 7B, 7C and FIG. 7D, a method of printing a spacer will be explained.

A spacer-printing apparatus 100, a plurality of printing boards 200 and a plurality of display boards 300 are arranged. The printing boards 200 are disposed on a first working stage 10 in a matrix. The display boards 300 are disposed on a second working stage 20 in a matrix. The printing boards 200 and the display boards 300 are disposed at a position corresponding each other. For example, an area of each printing board 200 is substantially the same as an area of each display board 300.

Then, ink spacers 30 are dropped onto each printing board 200 by using an ink dropping machine 40. The ink spacers 30 fill in grooves 210 of each printing board 200 by using a blade 50.

The ink spacers 30 are attached to all or substantially all portions of the curved surface of the printing roller 110 at the same time by using the moving part 120. For example, an area of the curved surface of the printing roller 110 is larger than an area of the printing board 200. For example, if the number of the display boards 300 is N, the area of the curved surface of a printing roller 110 is N-times as large as the area of the printing board 200.

The printing roller 110 having the ink spacers 30 attached thereto is aligned on the display board 300. The ink spacers 30 are transferred to the display boards 300 at the same time by using the moving part 120.

As described above, by using the printing boards 200, the ink spacers 30 are attached to all or substantially all portions of the curved surface of the printing roller 110 and the ink spacers 30 are attached onto the display boards 300. As a result, the time required for printing spacers is decreased.

A plurality of display boards 300 is disposed on a second working stage 20 in a matrix. However, a display board 300 may include a plurality of display regions 310 as in FIG. 9. For example, a size of a display region 310 corresponds to a size of a printing board 200 and the area of each display region 310 is substantially the same as the area of each printing board 200.

According to the embodiments of the present invention, since a printing roller has a shape of a portion of the cylinder, a radius can be increased without increasing the volume and weight. As a result, increase of cost for manufacturing a display panel due to increased volume and weight of a printing roller can be prevented.

Also, by relatively moving a printing board with respect to the printing roller, the ink spacers are attached to all portions of the curved surface of the printing board, and the ink spacers are attached to the display boards at the same time. As a result working efficiency of printing spacers can be enhanced.

By using a plurality of printing boards, the ink spacers are attached to all or substantially all portions of the curved surface of the printing roller and the ink spacers are attached to a plurality of display boards. As a result, the required time for printing spacers is decreased.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A spacer-printing apparatus comprising:

a printing roller having opposite edges, wherein the opposite edges are connected by a curved surface to which spacers are attached; and a moving part connected to the printing roller, wherein the moving part includes a plurality of extended portions connected adjacent each of the opposite edges, and wherein the extended portions alternately move up and down in a reciprocating motion to alternately move the opposite edges up and down.

2. The spacer-printing apparatus of claim 1, wherein a cross-section of the curved surface is substantially symmetric with respect to a centerline of the cross-section.

3. The spacer-printing apparatus of claim 1, wherein a cross section of the curved surface is a substantially circular arc.

4. The spacer-printing apparatus of claim 3, wherein a length of the substantially circular arc ranges from about 1/18 to about ½ of a total circumference.

5. The spacer printing apparatus of claim 1, wherein a section of the printing roller has a concave shape.

6. The spacer-printing apparatus of claim 1, wherein the printing roller comprises:

a main body part including the opposite edges connected by the curved surface; and an external surface part disposed on the curved surface, wherein a spacer attaches to the external surface part.

7. The spacer-printing apparatus of claim 1, wherein the plurality of extended portions are a plurality of pistons alternately moving the opposite edges of the printing roller up and down.

8. A method of printing a spacer, comprising:

attaching a spacer to a printing roller wherein opposite edges of the printing roller are connected with a curved surface; and attaching the spacer to a display board by alternately moving the opposite edges of the printing roller up and down to contact the curved surface with the display board by using a moving part connected to the printing roller, wherein the moving part includes a plurality of extended portions connected adjacent each of the opposite edges, and wherein the extended portions alternately move up and down in a reciprocating motion to alternately move the opposite edges up and down.

9. The method of claim 8, wherein attaching the spacer to the air printing roller comprises:

disposing the spacer on a printing board; and attaching the spacer to the curved surface by moving, with the moving part, the opposite edges of the printing roller to contact the curved surface with the printing board.

10. The method of claim 9, wherein the printing board comprises a plurality of receiving grooves for receiving a plurality of spacers.

11. The method of claim 10, wherein attaching the spacer to the printing board comprises:

dropping a plurality of spacers onto the printing board; and filling the receiving grooves with the spacers by moving the plurality of spacers across the printing board in a predetermined direction.

12. The method of claim 11, wherein the plurality of spacers is distributed in ink.

13. The method of claim 9, wherein an area of the curved surface corresponds to an area of the printing board.

14. The method of claim 13, wherein the area of the curved surface corresponds to an area of the display board.

15. The method of claim 9, wherein an area of the curved surface is larger than an area of the printing board.

16. The method of claim 15, wherein attaching the spacer to the printing roller further comprises moving the printing board with respect to the printing roller.

17. The method of claim 15, wherein a plurality of printing boards are disposed at a position corresponding to the printing roller and spacers disposed on the plurality of printing boards are simultaneously attached to the curved surface.

18. The method of claim 9, wherein an area of the curved surface is larger than an area of the display board.

19. The method of claim 18, wherein a plurality of display boards are disposed at a position corresponding to the printing roller, and spacers disposed on the curved surface are simultaneously attached to the plurality of display boards.

20. The method of claim 19, wherein an area of the display board is substantially the same as an area of the printing board.

21. The method of claim 18, wherein the display board is divided into a plurality of display regions, and a plurality of spacers attached to the curved surface are simultaneously attached to the plurality of display regions.

22. The method of claim 21, further comprising cutting out each display region from the display board.

23. The method of claim 21, wherein an area of a display region is substantially the same as an area of the printing board.

* * * * *